US007942765B2

(12) United States Patent
Odabachian et al.

(10) Patent No.: US 7,942,765 B2
(45) Date of Patent: May 17, 2011

(54) AERODYNAMICALLY AND STRUCTURALLY SUPERIOR, FIXED-BLADE HUNTING ARROWHEAD

(75) Inventors: Arshag K. Odabachian, West Bloomfield, MI (US); Craig Winbigler, Brighton, MI (US); Stephan Thiele, Milford, MI (US); Karl Thiele, Milford, MI (US); Bryan John Wohlfeil, Walled Lake, MI (US)

(73) Assignee: Bradhart Products, Inc., Brighton, MI (US)

( * ) Notice: Subject to any disclaimer, the term of this patent is extended or adjusted under 35 U.S.C. 154(b) by 511 days.

(21) Appl. No.: 12/062,754

(22) Filed: Apr. 4, 2008

(65) Prior Publication Data

US 2008/0254925 A1 Oct. 16, 2008

Related U.S. Application Data

(60) Provisional application No. 60/921,800, filed on Apr. 4, 2007.

(51) Int. Cl.
*F42B 6/08* (2006.01)

(52) U.S. Cl. ..... 473/583; 473/584

(58) Field of Classification Search ..... 473/583, 473/584

See application file for complete search history.

(56) References Cited

U.S. PATENT DOCUMENTS

| | | | | |
|---|---|---|---|---|
| 4,349,202 | A * | 9/1982 | Scott | 473/584 |
| 4,452,459 | A * | 6/1984 | Doonan | 473/584 |
| 4,940,246 | A * | 7/1990 | Stagg | 473/583 |
| 4,974,859 | A * | 12/1990 | Briesemeister | 473/584 |
| 5,931,751 | A * | 8/1999 | Cooper | 473/583 |
| 6,322,464 | B1 * | 11/2001 | Sestak | 473/583 |
| 6,830,523 | B1 * | 12/2004 | Kuhn | 473/583 |

* cited by examiner

*Primary Examiner* — John Ricci

(74) *Attorney, Agent, or Firm* — Harness, Dickey & Pierce, PLC

(57) ABSTRACT

An aerodynamically and structurally superior, fixed-blade hunting arrowhead providing higher penetration coupled with a structurally sound, non-deflecting, blade-cutting area to take down wild game quickly and humanely. The assembly includes the ferrule, main blade, and sub-blade, wherein the unitary ferrule has a machined structure that holds and reinforces the blade units as well as incorporates a concave-faceted cutting tip, blade-location channels, cavities for blade snap retention, and rearmost threaded portion for attachment to a standard arrow insert. The main blade is a one-piece element which incorporates two forward-cutting blades and two rear blades, as well as rearmost anchoring projections attaching the blade to the ferrule. The sub-blade is a one-piece element positioned perpendicular to the main blade and is retained in the same manner as the main blade by integrated projections snapping into cavities within the ferrule.

23 Claims, 3 Drawing Sheets

AERODYNAMICALLY AND STRUCTURALLY SUPERIOR, FIXED-BLADE HUNTING ARROWHEAD

CROSS-REFERENCE TO RELATED APPLICATIONS

This application claims the benefit of U.S. Provisional Application No. 60/921,800, filed on Apr. 4, 2007. The disclosure of the above application is incorporated herein by reference.

FIELD

The present disclosure relates generally to fixed-blade hunting broadhead. More specifically, it relates to an aerodynamically and structurally superior, fixed-blade hunting arrowhead for the bow hunter to have an accurate and energy-conserving, fixed-blade broadhead that will provide higher penetration coupled with a structurally sound, non-deflecting, blade-cutting area to take down wild game as fast and as humanly as possible.

BACKGROUND

The statements in this section merely provide background information related to the present disclosure and may not constitute prior art.

It can be appreciated that fixed-blade hunting broadhead have been in use for years. Typically, fixed-blade hunting broadhead are comprised of NAP Thunderhead, Nitron, Razorcaps, Muzzy 3 and 4 blade, Muzzy Phantom, ABC Sonic, Interloc, Fuse, Steel force, Grim Reaper, etc. These and others are covered in the prior art, for example, U.S. Pat. No. 2,137,014, issued in November of 1938 to Brochu; U.S. Pat. No. 2,686,055, issued in August of 1954 to Peltz; U.S. Pat. No. 2,829,894, issued in April of 1958 to Henkel; U.S. Pat. No. 2,940,758, issued in June of 1960 to Richter; U.S. Pat. No. 3,741,542, issued in June of 1973 to Karbo; U.S. Pat. No. 3,756,600, issued in September of 1973 to Maleski; U.S. Pat. No. 3,854,723, issued Dec. 17, 1974, to Wilson; U.S. Pat. No. 3,887,186, issued in June of 1975 to Matlock; U.S. Pat. No. 3,915,455, issued in October of 1975 to Savora; U.S. Pat. No. 4,146,226, issued in March of 1979 to Sorensen; U.S. Pat. No. 4,169,597, issued in October of 1979 to Maleski; U.S. Pat. No. 4,175,749, issued in November of 1979 to Simo; U.S. Pat. No. 4,210,330, issued in July of 1980 to Kosbab; U.S. Pat. No. 4,349,202, issued in September of 1982 to Scott; U.S. Pat. No. 4,381,866, issued in May of 1983 to Simo; U.S. Pat. No. 4,410,184, issued in October of 1983 to Anderson; U.S. Pat. No. 4,529,208, issued in July of 1985 to Simo; U.S. Pat. No. 4,537,404, issued in August of 1985 to Castellano et al.; U.S. Pat. No. 4,671,517, issued in June of 1987 to Winters; U.S. Pat. No. 4,807,889, issued in February of 1989 to Johnson; U.S. Pat. No. 5,165,697, issued Nov. 24, 1992, to Lauriski et al.; U.S. Pat. No. 6,306,053, issued Oct. 23, 2001, to Liechty, II; and U.S. Pat. No. 6,530,853, issued Mar. 11, 2003, to Giannetti.

The main problem with conventional fixed-blade hunting broadhead is accuracy. When it comes to hunting arrowheads (a/k/a broadheads), there are two basic types in use today. The "fixed" blade is one in which all cutting surfaces are exposed and there is no moving blades or other parts once the broadhead has been assembled and affixed to the arrow. The other is the "mechanical" or "expandable" in which some sort of blade deployment system(s) is used regardless if some fixed blade is also affixed to the unit.

The mechanicals started displacing a good share of the fixed-blade market for the sole reason of advertised superior flight and accuracy characteristics over the fixed-blade designs. Since there was significantly less exposed blade surface with the mechanical designs, this made sense. Bow hunters were always looking for a broadhead that would behave in flight, exactly like their target practicing non-bladed field points. Some of the better designed mechanicals (like the Aftershock Archery "Hypershock") would actually do this.

In the world of bowhunting, there are certain factors involved in a successful harvest of game that are indisputable. Three primary and very crucial factors come into light. Accuracy is one. If the broadhead does not have accurate flight characteristics, the chance of hitting the optimum location of the vital organs is severely compromised. An overwhelming majority of fixed-blade designs suffer from inaccurate flight caused primarily by inadequate aerodynamic principals applied to the design, as well as designs that create an unacceptable amount of aerodynamic drag. Most of this drag comes from uncontrolled turbulence created by the leading edge and/or tip as well as blades inserted into the tip, the main cutting blade design, location, angles and indexing of those blades to the cutting tip and/or ferrule shape as well as positioning therein. Some designs even employ tabs, twisted blades, or bent trailing edges to impart "spin" into the arrow assembly to facilitate the in-flight averaging of arrow assembly issues and/or misalignments in the hope of gaining tighter groups in the target.

Regardless if the "grouping" of arrows being shot into a target does improve, physics as well as testing reveals that the aerodynamic drag required to spin the assembly in flight is requiring that a remarkable portion of the kinetic energy imparted by the bow to the arrow assembly be used to do this "spinning." Whatever portion of the broadhead's blades and the arrow's rear feathers or vanes that are not in perfect rotational angles and harmony with the broadhead's spinning fails to match those imparted RPM's, results in the assembly turning into a centrifugal air pump, which in turn requires ever greater amounts of kinetic energy to be drained from the forward momentum of the assembly. This consequently results in a lower amount of downrange kinetic energy and imparts (at the very least) a vertical drop and loss of speed at target not seen with the equivalent weight field point.

Accuracy has been partially addressed by some fixed-blade designs by reducing the total cutting area and/or cutting diameter of the blades. This reduction in blade area will help improve accuracy by reducing the kinetic energy loss attributed to drag, but the lethality and subsequent killing power of the broadhead has been severely compromised. Another problem with conventional fixed-blade hunting broadhead is that the insufficient structure or reinforcing structure of razor-type tips causes not only blade deformation as well as blade loss issues, it can also severely compromise the penetrating power of the broadhead into hard objects, such as bone. There are two primary types of so-called razor-sharp tips (a/k/a cut-on-contact). The first type dates back to stone arrowheads, whereby the main blade and its cutting surface come all the way up to form the tip. The cutting angle or curved shape is irrelevant. The stone has been replaced by steel in the modern art (as well as using more than two cutting surfaces in many designs), but the principle and ease of manufacture has remained the same.

The issue with this design is weight, strength at the tip, and inaccuracy caused by excessive surface area. The other primary cut-on-contact design currently in use employs add-on blades, either to the tip directly or sharpening of the tip material used by either the ferrule or another material of tip affixed to the ferrule. These designs are prone to blade-retention issues as well as kinetic energy loss due to mechanical movement of the fastening method and/or retention in their corresponding channels or slots.

Another problem with conventional fixed-blade hunting broadheads is penetration performance. Compared to firearm hunters, the bowhunter has very limited energy in his/her arrow assembly and has to deal with real world issues concerning hitting bone prior to contacting the vital organs. The current and prior art will show that many designs have only the main blade-cutting surface extending forward and forming the tip. These are not considered bone-shattering tips and consequently go into a "wedging" condition as they attempt to travel through bone. This is already assuming that the leading edge of the blade is not deformed or broken immediately upon impact with hard bone. This wedging occurs from a simple physics issue of a small (blade thickness only) cavity being cut into the bone and having the surface area of the broadhead constantly increase as it tries to pass through. Inherent of these designs, the blade(s) becomes continually wider, increasing surface area and friction starting from the moment of contact by the tip. The ferrule (if any) will only exacerbate the wedging issue further as it increases the total surface area, as well. Even the designs that stop the main blades short of the tip, where a tip (cutting, bone-shattering, or otherwise) is employed, that have ferrule cross-sections larger than the cavity the tip produced, will go into wedging condition, as well.

The first true non-wedging, bone-shattering tip/ferrule design was incorporated into the Aftershock Hypershock broadhead, whereby the ferrule and exposed blade cross-section directly behind the cutting tip was smaller than the cavity the tip would produce. While these devices may be suitable for the particular purpose to which they address, they are not as suitable for the bowhunter to have an accurate and energy-conserving, fixed-blade broadhead that will provide higher penetration coupled with a structurally sound non-deflecting blade-cutting area to take down wild game as fast and as humanly as possible.

In these respects, the aerodynamically and structurally superior, fixed-blade hunting arrowhead according to the present invention substantially departs from the conventional concepts and designs of the prior art and, in so doing, provides an apparatus primarily developed for the purpose of the bowhunter to have an accurate and energy-conserving, fixed-blade broadhead that will provide higher penetration coupled with a structurally sound, non-deflecting blade-cutting area to take down wild game as fast and as humanly as possible.

SUMMARY

In view of the foregoing disadvantages inherent in the known types of fixed-blade hunting broadhead now present in the prior art, the present invention provides a new aerodynamically and structurally superior, fixed-blade hunting arrowhead construction wherein the same can be utilized for the bowhunter to have an accurate and energy-conserving, fixed-blade broadhead that will provide higher penetration coupled with a structurally sound non-deflecting blade-cutting area to take down wild game as fast and as humanly as possible.

The general purpose of the present invention, which will be described subsequently in greater detail, is to provide a new aerodynamically and structurally superior, fixed-blade hunting arrowhead that has many of the advantages of the fixed-blade hunting broadhead mentioned heretofore and many novel features that result in a new aerodynamically and structurally superior, fixed-blade hunting arrowhead which is not anticipated, rendered obvious, suggested, or even implied by any of the prior art fixed-blade hunting broadhead, either alone or in any combination thereof.

To attain this, the present invention generally comprises the ferrule, main blade, and sub-blade. The ferrule has a machined structure that holds and reinforces the blade units as well as incorporates the concave faceted cutting tip, blade location channels, cavities for blade snapretention, and rearmost threaded portion for attachment to a standard arrow insert. The main blade is a one-piece stainless steel unit that incorporates the cut-on-contact forward blades, the two main rear blades, as well as the rearmost anchoring projections that snap into the ferrule on the inside as well as seat into the arrow insert on the periphery. The sub-blade is a one-piece stainless steel unit that has two cutting surfaces that slide into a discrete slot in the ferrule and is retained in the same manner as the main blade by means of integrated projections snapping into cavities within the ferrule.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an aerodynamically and structurally superior, fixed-blade hunting arrowhead that will overcome the shortcomings of the prior art devices.

Another object of the present invention is to provide an aerodynamically and structurally superior, fixed-blade hunting arrowhead for the bowhunter to have an accurate and energy-conserving, fixed-blade broadhead that will provide higher penetration coupled with a structurally sound non-deflecting, blade-cutting area to take down wild game as fast and as humanly as possible.

Another object is to provide an aerodynamically and structurally superior, fixed-blade hunting arrowhead that has a cut-on-contact, razor-sharp tip that is actually and structurally the same as the rear main cutting blades that snap-locks into the ferrule channel and requires no screws, washers, welds, or crimps to be assembled.

Another object is to provide an aerodynamically and structurally superior, fixed-blade hunting arrowhead that is aerodynamically superior to other designs by way of using an aligned concave, 4-facet cutting tip that provides four (4) discrete channels of low and high-pressure air to stabilize the front of the arrow, thereby significantly reducing wind steering and their associated accuracy issues.

Another object is to provide an aerodynamically and structurally superior, fixed-blade hunting arrowhead that uses the 4-channel concave tip that is aligned axially with the main and/or sub-cutting blades to reduce wind-planing as well as to initiate a wound channel that the main blades can follow with less resistance.

Another object is to provide an aerodynamically and structurally superior, fixed-blade hunting arrowhead that has superior strength to other designs in that the forwardmost cutting tip is part of the main rear blade that is one-piece mechanically coupled to the arrow insert to provide the greatest transfer of kinetic energy without losses attributed to hysteresis from deflecting and/or yielding broadhead components.

Another object is to provide an aerodynamically and structurally superior, fixed-blade hunting arrowhead that has no cutting surface or exposed blade area in the mid-section that would otherwise hinder its ability to anchor a non-deflecting flight path when contacting game at severe angles.

Another object is to provide an aerodynamically and structurally superior, fixed-blade hunting arrowhead that has a forward-cutting tip that creates a cutting diameter and bone-fracture zone larger than the midsection to facilitate a non-wedging anchored flight path as well as stable penetration before the main blades encounter tissue.

Another object is to provide an aerodynamically and structurally superior, fixed-blade hunting arrowhead that has a Type 3 anodized (a/k/a Hardcoat) ferrule for the purposes of durability, surface hardening, lower coefficient of friction, and corrosion resistance.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated.

DRAWINGS

The drawings described herein are for illustration purposes only and are not intended to limit the scope of the present disclosure in any way.

DETAILED DESCRIPTION

Figure 1:
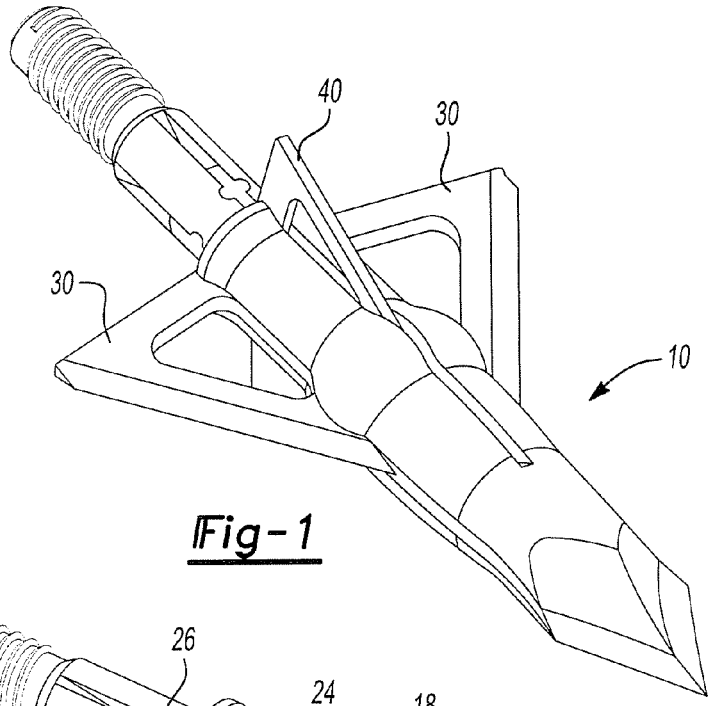
FIG. 1 is a perspective view of the preferred embodiment comprising the assembled arrowhead.
Figure 2A:
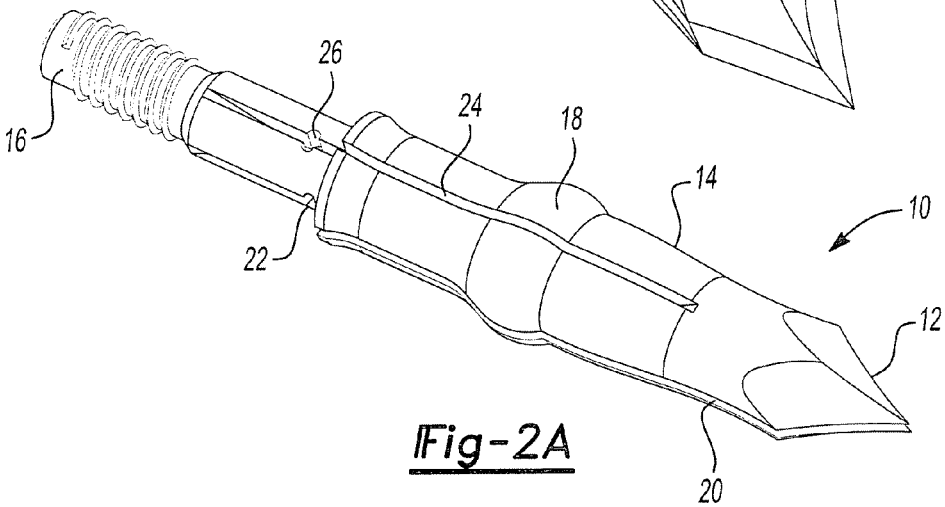
FIG. 2A is a perspective view of the ferrule of the preferred embodiment shown in FIG. 1.
Figure 2B:
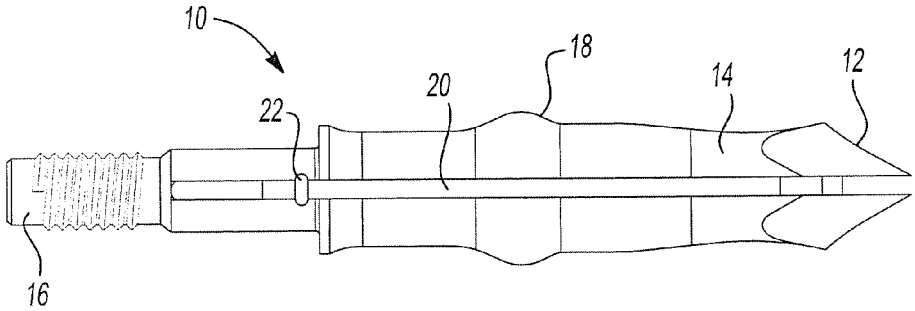
FIG. 2B is a planar, overhead view of the ferrule of the preferred embodiment shown in FIG. 1.
Figure 2C:
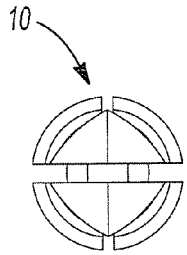
FIG. 2C is an end view of the ferrule of the preferred embodiment shown in FIG. 1.
Figure 3A:
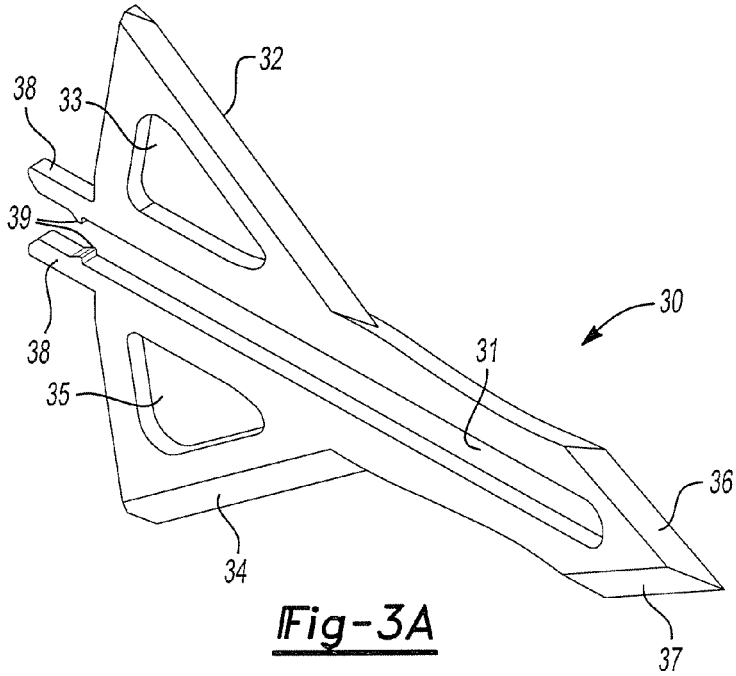
FIG. 3A is a perspective view of the one-piece cutting tip and main blade unit.
Figure 3B:
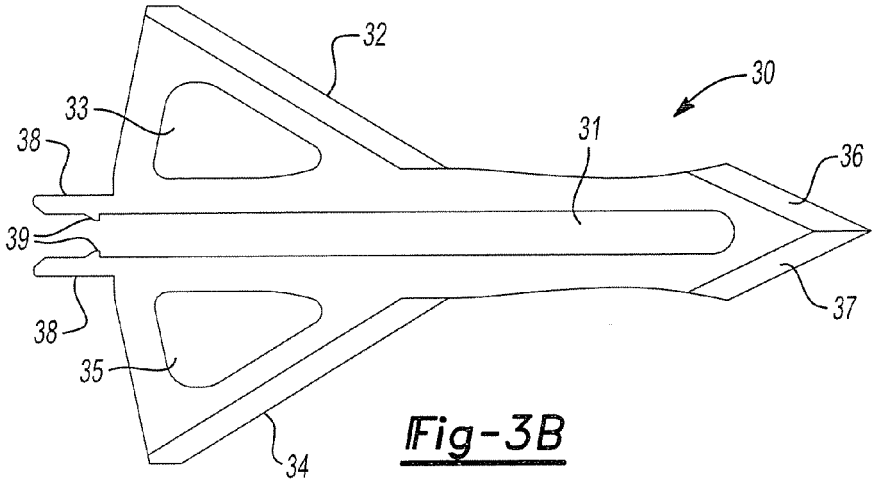
FIG. 3B is a planar, overhead view of the one-piece cutting tip and main blade unit.
Figure 3C:
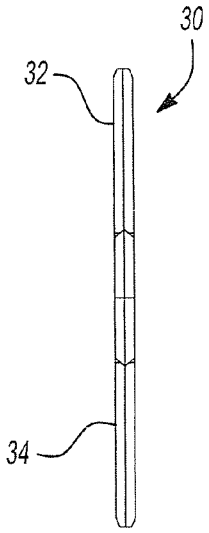
FIG. 3C is an end view of the one-piece cutting tip and main blade unit.
Figure 4A:
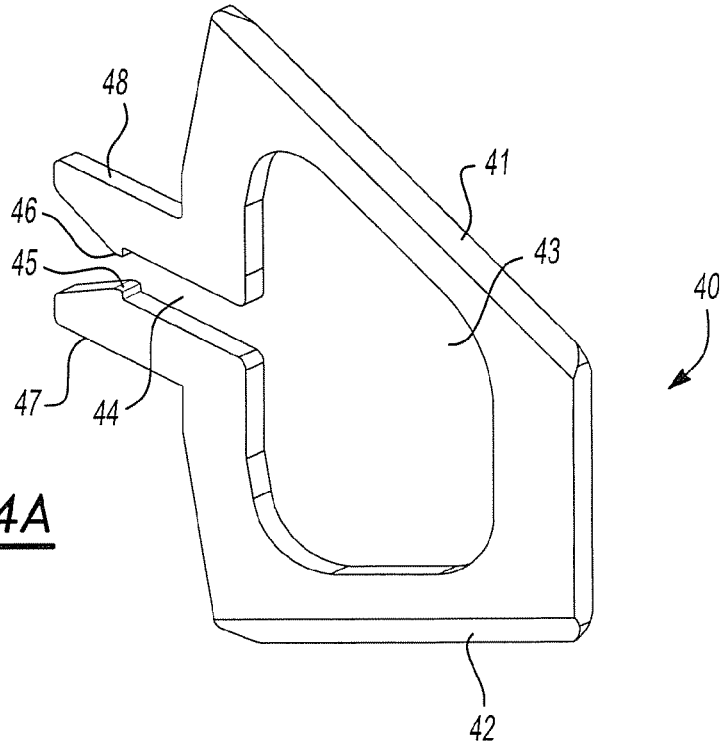
FIG. 4A is a perspective view of the one-piece, sub-blade element of the preferred embodiment shown in FIG. 1.
Figure 4B:
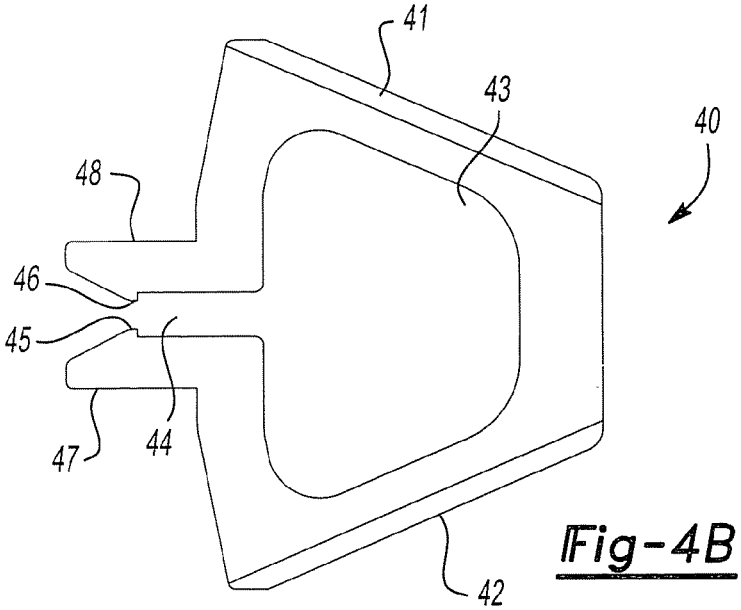
FIG. 4B is a planar, overhead view of the one-piece, sub-blade element of the preferred embodiment shown in FIG. 1.
Figure 4C:
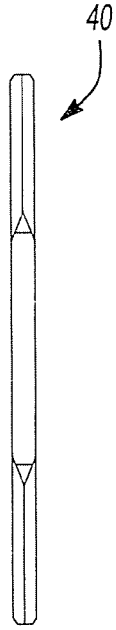
FIG. 4C is an end view of the one-piece, sub-blade element of the preferred embodiment shown in FIG. 1.

The following description is merely exemplary in nature and is not intended to limit the present disclosure, application, or uses. It should be understood that throughout the drawings, corresponding reference numerals indicate like or corresponding parts and features.

Turning now descriptively to the drawings, in which similar reference characters denote similar elements throughout the several views, the attached figures illustrate an aerodynamically and structurally superior, fixed-blade hunting arrowhead 10, which comprises the ferrule 14, main blade 30, and sub-blade 40. The ferrule 14 has a machined structure that holds and reinforces the blade units 30 and 40 as well as incorporates the concave faceted cutting tip 12, blade location channels 20 and 24, cavities 22 and 26 for blade snap retention, and rearmost threaded portion 16 for attachment to a standard arrow insert.

The main blade 30 is a one-piece stainless steel unit that incorporates the cut-on-contact forward blades 36 and 37, a central longitudinal slot which receives the sub-blade 40, the two main rear blades 32 and 34 which have bored-out center apertures 33 and 35 to decrease weight, as well as rearmost anchoring projections 38 having inward oriented tangs 39 that snap into the ferrule 14 on the inside as well as seat into the arrow insert on the periphery.

The sub-blade 40 is a one-piece stainless steel unit that has two cutting surfaces 41 and 42 that slide into a discrete slot 24 in the ferrule 14, and is retained in the same manner as the main blade by means of integrated projections 47 and 48 comprising inward oriented tabs 45 and 46, which snap into cavities 26 within the ferrule 14.

The ferrule 14 has a machined structure that holds and reinforces the blade units as well as incorporates the concave faceted cutting tip 12, blade location slots 20 and 24, and cavities 22 and 26 for blade snapretention and rearmost threaded portion 16 for attachment to a standard arrow insert. The ferrule 14 is a machined, one-piece component of the broadhead 10 that holds, aligns, and reinforces the blade units. At the rear, it incorporates the industry standard AMO shank and threads 16 for screw-on attachment to standard arrows or crossbow bolts. The front or tip portion has a concave 4-facet cutting area 12 that is radially aligned with the blade slots and has a compound slot 20 running longitudinally through it to facilitate locating and reinforcing the main blade unit 30.

Positioned 90 degrees to the main blade 30, slot 24 is the sub-blade slot that is cut through the body of the ferrule 14. Both sets of slots 20 and 24 terminate at the rear locating shank that incorporates cavities 22 and 26, respectively, which receive anchoring projections 38 and integrated projections 47 and 48 located on the rearmost portion of each blade unit, respectively. The major radial diameter of the extremities of the tips 12 cutting edges exceeds that of the mid portion of the ferrule 14. Although the current embodiment of the ferrule 14 is a fully machined 7075-T6 that is type 3 anodized, the materiel and/or coating selections are irrelevant to the design intent. The ferrule 14 may be longer, shorter, wider, narrower, lighter or heavier, depending on the market needs.

The main blade 30 is a one-piece stainless steel unit that incorporates the cut-on-contact forward blades 36 and 37, the two main rear blades 32 and 34, as well as the rearmost anchoring projections 38 that snap into the ferrule 14 on the inside as well as seat into the arrow insert on the periphery. The main blade 30 is a one-piece stainless steel component that has two forward cutting surfaces 36 and 37 that are designed to protrude from the tip of the ferrule 14, followed by the non-cutting spine section, followed by the two rear main cutting surfaces 32 and 34. The main blade unit incorporates two engagement tangs 39 on the interior of the rearmost anchoring projections 38 for the purpose of exact location and locking of the blade unit to the ferrule 14. The engagement tangs 39 incorporate an angled ramp on the rear to facilitate minor spreading of the blade legs and make it easier to load it onto the ferrule 14. The main blade material, thickness, cutting angles, and alloys may change as required by the intended function as for reasons of material choice and improvement. The spine area may or may not protrude from the surface of the ferrule 14. The spine area may or may not contain cutting edges. The rearmost portion (trailing edge) may or may not be sharpened. The engagement tangs 39 may change shape, size, and location as required by any material change.

The sub-blade 40 is a one-piece stainless steel unit that has two cutting surfaces 41 and 42 that slide into slot 24 in the ferrule 14 and are retained in the same manner as the main blade by means of integrated projections 47 and 48 snapping into cavities within the ferrule 14. The sub-blade 40 is a one-piece stainless steel component that has two angled cutting surfaces 41 and 42 connected by a forward non-cutting portion that when inserted into the ferrule 14, becomes a non-visible support. The sub-blade 40 incorporates two engagement tangs 45 and 46 on the interior of the rearmost projections 47 and 48 for the purpose of exact location and locking of the blade unit to the ferrule 14. The engagement tangs 45 and 46 incorporate an angled ramp on the rear to facilitate minor spreading of the blade legs via central cutout 43 and make it easier to load it onto the ferrule 14. The sub-blade material, thickness, cutting angles, and alloys may change as required by the intended function as for reasons of material choice and improvement. The support area may or may not change shape. The rearmost portion (trailing edge) may or may not be sharpened. The engagement tangs 45 and 46 may change shape, size, and location as required by any material change.

Using its own discrete slot 20 machined into the ferrule, the main blade 30 slides onto and locks into place on the ferrule 14. The sub-blade unit 40 is loaded into its own ferrule slot 24 from the side, pushed down towards the rear of the ferrule where its engagement tangs 45 and 46 lock it into place. The broadhead is complete and ready to use with or without the sub-blade 40 installed. Although the present embodiment of the design incorporates a total of six (6) discrete cutting surfaces, changes in shape, size, length, number of blades and or cutting surfaces, materials, cutting surface type, or preparation can take place.

The assembled broadhead 10 is used on a hunting arrow preferably released from either a bow or crossbow. The hunting arrow must have an industry standard insert within the arrow to facilitate proper mounting of the broadhead. When the broadhead 10 is shot, the axially aligned, concave four-facet cutting tip 12 creates four (4) discrete channels of high and low air-pressure zones that also establish controlled eddie currents directly behind the cutting tip 12 that partially blind the rear blades from laminar air flow and aid in its superior flight. These stabilizing flight characteristics are also due to the reduction in diameter of the blade and ferrule 14 directly behind the cutting tip 12. Once the broadhead finds its mark and encounters game, the razor sharp tip blades 36 and 37 of the main blade penetrate first. This razor sharp portion is surrounded and supported by the ferrule 14 that is also a cutting surface. The ferrule's cutting facets 12 are machined into it at 90 degrees to the main blade's cutting tip. If the broadhead encounters bone (such as the ribcage or shoulder), the tip portion of the broadhead 10 will create fractures and break out of the way a portion of bone the same size, or larger than, the cutting tip's dimensions. The mid section of the ferrule 14 and main blade directly behind the cutting tip are reduced in size to combat any energy robbing wedging forces as forward motion progresses, as well as to help anchor the established arrow flight path without deflection that may be encountered in a severely angled shot. Since the forward cutting tip of the main blade is a one-piece component that directly connects to the arrow's insert, as well as locking into the ferrule 14, the complete structure and subsequent lack of defecting and/or breaking components are superior to other designs employing any type of so-called razor style tip. Since the cutting surfaces on the tip are axially aligned with the rear blades, any fracture produced by the tip is followed by the rear blades without the rear blades having to create new fracture and/or cutting channels that would reduce the remaining kinetic energy in the arrow assembly. As the broadhead 10 continues forward into the game, the rear blades come in contact with vital organ tissue and proceed to cause internal hemorrhaging. The efficient flight and entry into game that this design exhibits conserves kinetic energy and consequently increases the odds of the broadhead passing through the game to create an exit wound channel that would help the hunter in quick tracking as well as a quick and humane expiration of the animal.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention to include variations in size, materials, shape, form, function and manner of operation, assembly, and use are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described and, accordingly, all suitable modifications and equivalents may be resorted to, falling within the scope of the invention.

What is claimed is:

1. A broadhead arrow assembly, said assembly comprising:

a main body ferrule, said ferrule having a penetrating tip, a generally cylindrical main body, a threaded arrow-attachment end opposite said penetrating tip, and a pair of longitudinal slots in said main body, perpendicular to each other, the first of said pair of slots extending to and conjoining at the penetrating tip, and the second of said pair of slots extending partially up the ferrule;

a main blade defining a one-piece unit having two forward blades at a first end and two outwardly projecting, planar rear blades at a second end and two anchoring projections at said rear end which snap into said ferrule when said main blade element is positioned within said first of said pair of slots on said ferrule; and a sub-blade, said sub-blade defining a planar, one-piece element having two planar cutting surfaces, one positioned on a first side and the second positioned on a second side, said sub-blade being positioned through the second of said pair of slots in said ferrule, perpendicular to said main blade, wherein the two planar cutting surfaces are extended out from each side of said ferrule, said sub-blade further comprising two integrated projections at a rear end of said sub-blade, which snap into said ferrule when said sub-blade element is positioned within said second of said pair of slots on said ferrule.

2. The broadhead arrow assembly of claim 1, wherein said penetrating tip of said ferrule comprises a concave, four-facet cutting area, aligned radially with said first and said second pair of slots in said ferrule.

3. The broadhead arrow assembly of claim 2, wherein said main blade and said sub-blade align with said four-facet cutting area of said tip of the ferrule.

4. The broadhead arrow assembly of claim 1, wherein said main blades comprise a cutting edge on the rear end of said main blade.

5. The broadhead arrow assembly of claim 1, wherein said ferrule is manufactured from at least one of the following materials: stainless steel, aircraft aluminum, or a metallic alloy.

6. The broadhead arrow assembly of claim 1, wherein said main blade is manufactured from at least one of the following materials: stainless steel, aircraft aluminum, or a metallic alloy.

7. The broadhead arrow assembly of claim 1, wherein said sub-blade is manufactured from at least one of the following materials: stainless steel, aircraft aluminum, or a metallic alloy.

8. The broadhead arrow assembly of claim 1, wherein said ferrule comprises a widened central portion proximal the position of said main blade and said sub-blade.

9. A broadhead arrow assembly, said assembly comprising:

a main body ferrule, said ferrule having a penetrating tip, a generally cylindrical main body, a threaded arrow attachment end opposite said penetrating tip, and at least one longitudinal slot in said main body, said longitudinal slot extending along each side up to and conjoining at the penetrating tip of the ferrule; and a main blade defining a one-piece unit having two forward blades at a first end, two outwardly projecting, planar rear blades at a second end, and two anchoring projections at said rear end which snap into said ferrule when said main blade is positioned within said at least one longitudinal slot on said ferrule.

10. The broadhead arrow assembly of claim 9, wherein said penetrating tip of said ferrule comprises a concave, four-facet cutting area, aligned radially with said at least one longitudinal slot in said ferrule.

11. The broadhead arrow assembly of claim 10, wherein said main blade aligns longitudinally with said four-facet cutting area of said tip of the ferrule.

12. The broadhead arrow assembly of claim 9, wherein said main blades comprise a cutting edge on the rear end of said main blade.

13. The broadhead arrow assembly of claim 9, wherein said ferrule is manufactured from at least one of the following materials: stainless steel, aircraft aluminum, or a metallic alloy.

14. The broadhead arrow assembly of claim 9, wherein said main blade is manufactured from at least one of the following materials: stainless steel, aircraft aluminum, or a metallic alloy.

15. The broadhead arrow assembly of claim 9, wherein said ferrule comprises a widened central portion proximal the position of said main blade.

16. A broadhead arrow assembly, said assembly comprising:

a main body ferrule, said ferrule having a penetrating tip, a generally cylindrical main body, a threaded arrow attachment end opposite said penetrating tip, and a pair of longitudinal slots in said main body, perpendicular to each other, the first of said pair of slots extending to and conjoining at the penetrating tip, and the second of said pair of slots extending partially up the ferrule;

a main blade defining a one-piece unit having two forward blades at a first end, two outwardly projecting, planar rear blades at a second end, and two anchoring projections at said rear end which snap into said ferrule when said main blade element is positioned within said first of said pair of slots on said ferrule, said main blade extending over and longitudinally forward from said penetrating tip when attached to said ferrule; and a sub-blade, said sub-blade comprising a planar, one-piece element having two planar cutting surfaces, one positioned on a first side and the second positioned on a second side, said sub-blade being positioned through the second of said pair of slots in said ferrule, perpendicular to said main blade wherein the two planar cutting surfaces are extended out from each side of said ferrule, said sub-blade further comprising two integrated projections at a rear end of said sub-blade, which snap into said ferrule when said sub-blade element is positioned within said second of said pair of slots on said ferrule.

17. The broadhead arrow assembly of claim 16, wherein said penetrating tip of said ferrule comprises a concave, four-facet cutting area, aligned radially with said first and said second pair of slots in said ferrule.

18. The broadhead arrow assembly of claim 17, wherein said main blade and said sub-blade align with said four-facet cutting area of said tip of the ferrule.

19. The broadhead arrow assembly of claim 16, wherein said main blades comprise a cutting edge on the rear end of said main blade.

20. The broadhead arrow assembly of claim 16, wherein said ferrule is manufactured from at least one of the following materials: stainless steel, aircraft aluminum, or a metallic alloy.

21. The broadhead arrow assembly of claim 16, wherein said main blade is manufactured from at least one of the following materials: stainless steel, aircraft aluminum, or a metallic alloy.

22. The broadhead arrow assembly of claim 16, wherein said sub-blade is manufactured from at least one of the following materials: stainless steel, aircraft aluminum, or a metallic alloy.

23. The broadhead arrow assembly of claim 16, wherein said ferrule comprises a widened central portion proximal the position of said main blade and said sub-blade.

* * * * *